US005558800A

United States Patent [19]

Page

[11] Patent Number: 5,558,800

[45] Date of Patent: Sep. 24, 1996

[54] MICROWAVE POWER RADIATOR FOR MICROWAVE HEATING APPLICATIONS

[75] Inventor: Derrick J. Page, Crownsville, Md.

[73] Assignee: Northrop Grumman, Baltimore, Md.

[21] Appl. No.: 491,664

[22] Filed: Jun. 19, 1995

[51] Int. Cl.[6] ..... H05B 6/72

[52] U.S. Cl. ..... 219/761; 219/748; 219/695; 330/295; 331/107 R; 331/110

[58] Field of Search ..... 219/761, 748, 219/746, 747, 750, 697, 695; 330/295, 124 R; 343/799, 800; 331/107 R, 108 R, 110

[56] References Cited

U.S. PATENT DOCUMENTS

| | | | |
|---|---|---|---|
| 3,557,333 | 1/1971 | McAvoy . | |
| 3,691,338 | 9/1972 | Chang . | |
| 3,867,607 | 2/1975 | Ohtani . | |
| 3,953,702 | 4/1976 | Bickel . | |
| 4,006,338 | 2/1977 | Dehn | 219/748 |
| 4,097,708 | 6/1978 | Bickel . | |
| 4,415,789 | 11/1983 | Nobue et al. | 219/750 |
| 4,504,718 | 3/1985 | Okatsuka et al. . | |
| 4,621,179 | 11/1986 | Kusunoki et al. | 219/747 |
| 4,714,812 | 12/1987 | Haagensen et al. | 219/750 |
| 5,179,264 | 1/1993 | Cuomo et al. | 219/761 |
| 5,208,554 | 5/1993 | Endler et al. | 330/295 |

*Primary Examiner*—Philip H. Leung
*Attorney, Agent, or Firm*—C. O. Edwards

[57] ABSTRACT

The output matching networks normally included in a microwave power transistor package as well as the transistor combining network therefor are eliminated for heating applications, e.g. microwave ovens. In a preferred embodiment, the transistor dies of four microwave silicon bipolar power transistors are directly connected to the low impedance points of a common patch type antenna element, also referred to as an applicator, located within the wall of a heating chamber in place of a magnetron. Each pair of power transistors are electrically spaced one half wavelength apart and are located transverse to each other on the antenna. The transistors are operated in pairs with a 180° phase difference so that mutually orthogonal longitudinal modes are excited in the antenna. Moreover, the transistors are frequency modulated over their prescribed frequency band to eliminate standing waves in the load, i.e. the article or substance being heated or cooked. Either one or a plurality of patch antennas can be used and operated, moreover, at two different frequencies allowed for heating applications, typically 915 MHz and 2450 MHz.

21 Claims, 3 Drawing Sheets

FIG.2
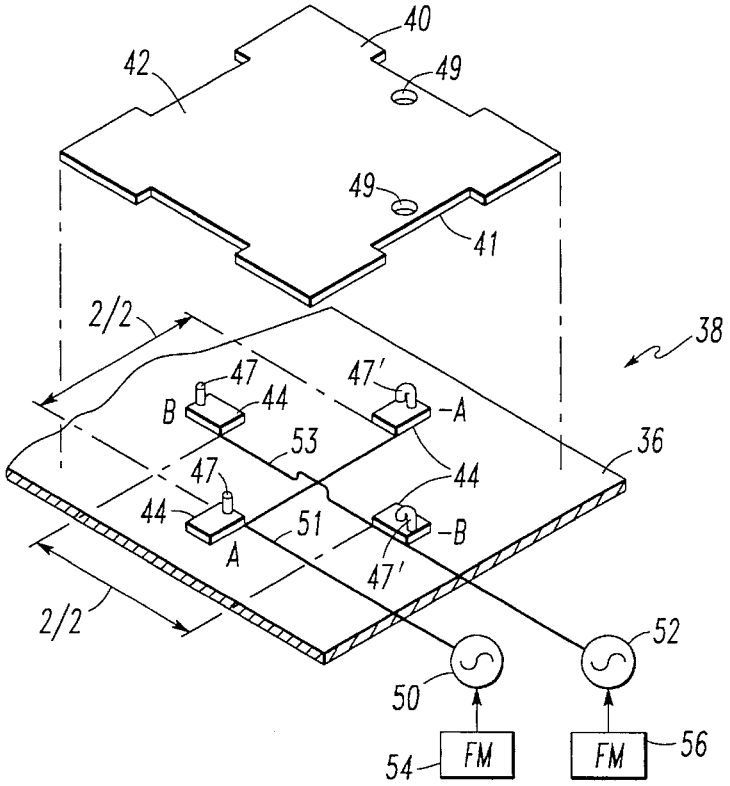
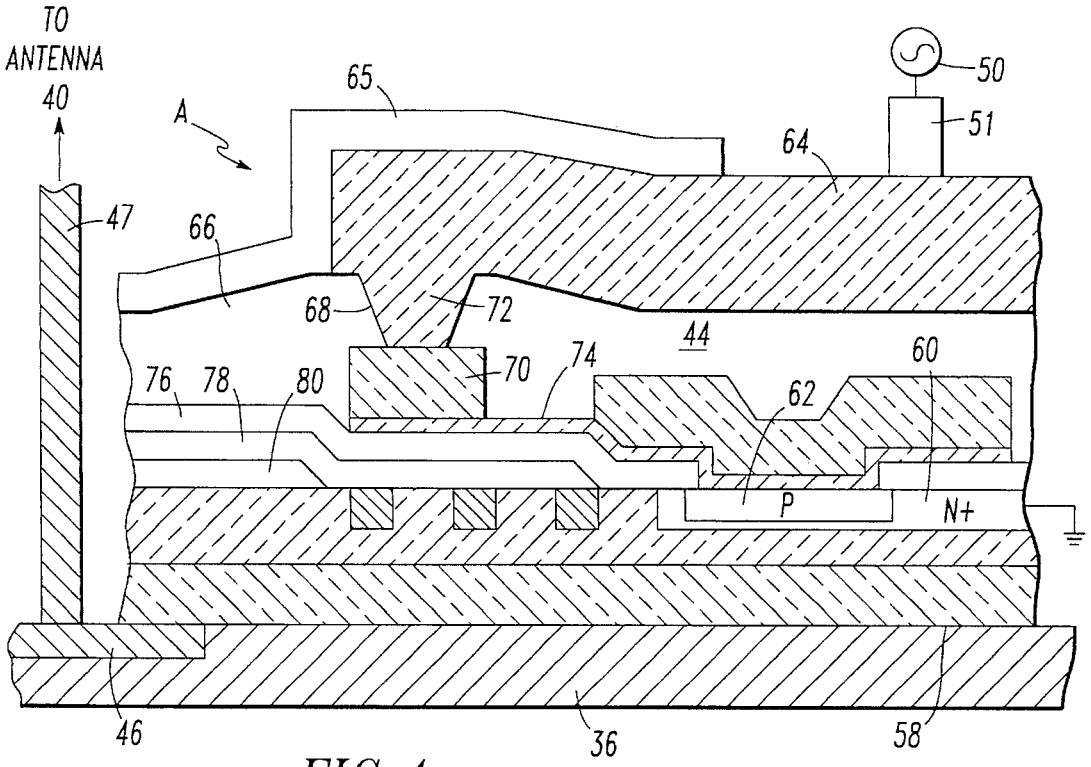
FIG.4

MICROWAVE POWER RADIATOR FOR MICROWAVE HEATING APPLICATIONS

BACKGROUND OF THE INVENTION

1. Field of the Invention

This invention relates generally to microwave heating apparatus and more particularly to a solid state microwave power source for microwave heating apparatus such as a microwave oven.

2. Description of the Prior Art

Microwave heating apparatus and more particularly the microwave oven is an outgrowth of the resistance heated electric oven and currently uses a low cost magnetron. Instead of electric power being used to heat the food by thermal conduction, microwave energy is introduced into the oven where it is absorbed by the water molecules within the food. The big difference from the resistance heated oven is that energy is efficiently absorbed by the food and the heating takes place within the bulk of the food rather than at the surface. The net result is that food is heated much more rapidly and most of the power is used to heat the food and very little is lost heating the oven and surroundings.

The operating frequency of a domestic microwave oven is commonly 2450 MHz, although some other frequencies are allowed. In North and South America, a frequency of 915 MHz is also allowed for industrial heating applications. The choice of operating frequency is normally based on the convenience of the magnetron. By choosing the 2450 MHz range, a relatively small magnetron tube can be used as the volume and mass of the magnetron is inversely proportional to the third power of the frequency. If, for example, a 915 MHz frequency is chosen, the magnetron and waveguide feed is typically larger and more expensive and is favored for industrial heating applications.

Since the invention of the transistor in 1947, there has been a steady substitution of the vacuum tube electronics by solid state devices. As a result, solid state microwave ovens were being patented as far back as 1971. An example comprises U.S. Pat. No. 3,557,330, entitled, "Solid State Microwave Oven", issued to Bruce R. McAvoy of the Westinghouse Electric Corporation, the assignee of the present invention. Another example of such apparatus is shown and disclosed in U.S. Pat. No. 3,691,338, entitled, "Solid State Microwave Heating Apparatus", issued to K Chang on Sep. 12, 1972. The combination of both magnetron and solid state type heating apparatus is further shown and described in U.S. Pat. No. 3,867,607, entitled, "Hybrid Microwave Heating Apparatus", issued to T. Ohtani on Feb. 18, 1975.

In early versions of the microwave oven, the food tended to be unevenly cooked. This was due to the presence of standing electromagnetic waves within the oven. Later ovens incorporated a small motor driven paddle to "stir" the microwave energy as it entered the oven and/or incorporated a rotating carousel within the oven onto which the food was placed.

More recently, a family of microwave silicon bipolar transistors for radar systems have been developed by the Westinghouse Electric Corporation, the present assignee. However, the cost of these devices has heretofore made it prohibitive for applications involving microwave heating because of the packaging and matching circuitry associated therewith and because relatively low cost magnetrons are readily available.

SUMMARY

Accordingly, it is an object of the present invention to provide an improvement in microwave heating apparatus.

It is a further object of the invention to provide an improvement in solid state microwave heating apparatus.

It is yet another object of the invention to provide an improvement in solid state domestic microwave ovens.

These and other objects of the invention are achieved in solid state heating apparatus by eliminating the output matching networks normally included in a microwave power transistor package as well as the transistor combining network used to connect several transistors in parallel. In a preferred embodiment, the transistor die of at least two pairs of microwave silicon bipolar power transistors are directly connected to the low impedance points of a common radiating antenna element, also referred to as an applicator, located in the wall of a heating chamber located in a housing, e.g. microwave oven. The transistors in each pair are operated 180° out of phase (anti-phase) and each of the pairs are transversely oriented relative to one another so that mutually orthogonal longitudinal modes are set up within the applicator. Moreover, the transistors are frequency modulated over their prescribed frequency band to eliminate standing waves in the load, i.e. the food being heated or cooked. One or more patch antennas can also operate at two different frequencies, typically 915 MHz and 2450 MHz. Where two operating frequencies are used, cooking performance can be improved because the lower frequency, not conventionally used in domestic ovens because of the size of the magnetron required, has a deeper penetration and will cook the center of large pieces of food.

BRIEF DESCRIPTION OF THE DRAWINGS

The following detailed description of the invention will be more readily understood when considered in conjunction with the accompanying drawings wherein:

FIG. 2 is an exploded perspective view of the preferred embodiment of the invention;

FIG. 4 is a cross-sectional view illustrative of a semiconductor structure of a microwave silicon bipolar transistor which can be utilized in connection with the embodiment shown in FIG. 2.

DETAILED DESCRIPTION OF THE INVENTION

This invention is directed to a new circuit and packaging configuration for an inexpensive microwave power radiator which will enable solid state devices to be applied to microwave heating applications in place of the magnetron and involves, among other things, integrating the transistor chip with the antenna.

Figure 1:
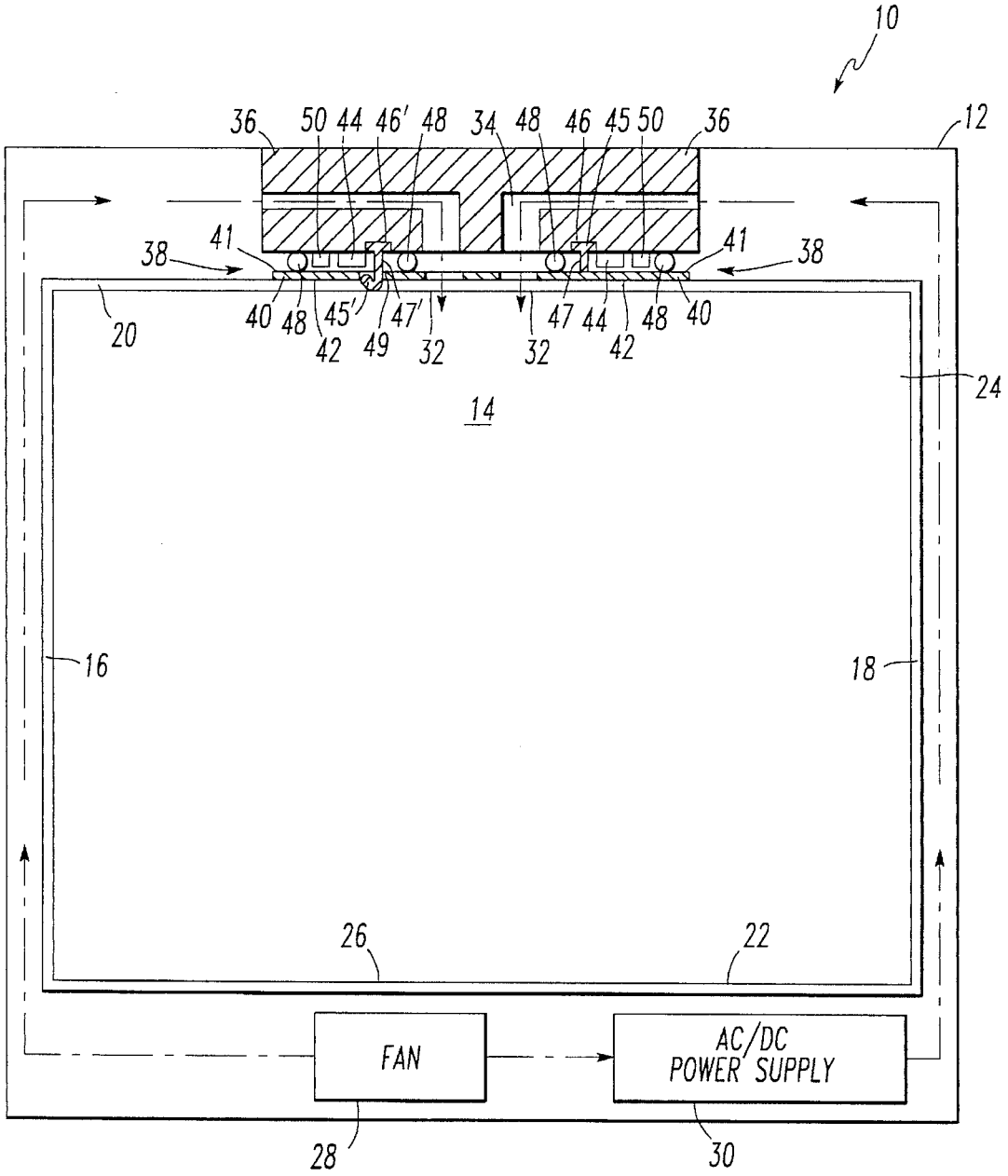
FIG. 1 is a mechanical schematic diagram generally illustrative of a domestic microwave oven which incorporates a radiating structure in accordance with the preferred embodiment of the invention.

Referring now to the drawings wherein like reference numerals refer to like parts throughout, reference is first made to FIG. 1 where reference numeral 10 denotes a microwave cooking oven comprised of an external housing 12 which includes an access door, not shown, to an internal heating chamber 14 for receiving one or more items therein which require defrosting, heating or cooking.

Further as shown in FIG. 1, the inner heating chamber 14 includes a pair of sidewalls 16 and 18, top and bottom walls 20 and 22, and a rear wall 24. The bottom wall 22 includes a surface 26 on which food or other articles requiring heating and/or cooking are placed. The space not occupied by the heating chamber 14 within the housing 12 is occupied by a circulating fan 28 and an AC/DC power supply 30 which are shown located in the bottom of the housing 12. The power supply 30 is adapted to supply electrical power to the electronics for generating microwave energy which is supplied to the heating chamber 14. The fan 28 is used to supply hot air, shown by the arrows, around the interior of the housing 10 and into the heating chamber 14 via aperture(s) 32 in the top wall 20 to flush out the moisture generated within the chamber 14 during a heating/cooking operation. The air supplied by the fan 28 is fed to the aperture(s) 32 by one or more channels 34 formed in a heat sink 36 for a microwave power source 38. The heat sink 36 is comprised of a relatively thick metal plate mounted in the top portion of the housing 12.

Referring also now to FIG. 2, the microwave power source 38 includes a common antenna element 40 for at least two microwave signals which independently excite two separate modes in the antenna. The antenna 40 comprises a patch antenna, also referred to in the art as an applicator, and which is generally flat and rectangular in configuration. The patch antenna direct connection element 40 is connected to the dies 44 of four microwave silicon bipolar transistors by way of direct connection elements 46, 47 and 46', 47'. The input impedance of an antenna varies with the point of connection to the signal source. In this invention a connecting point is chosen to match the output impedance of the source. Since the output impedance of microwave transistors are significantly lower than the 50 ohm or 300 ohm impedances typically encountered in microwave circuitry, low impedance connection points are necessary where direct connection thereto is made. Accordingly, the elements 47 connect to a pair of low impedance connection points 45 on the underside 41 of the antenna 40. The elements 47' connect to a pair of low impedance points 45' on the outerside 42 of the antenna 40 by way of a pair of feedthroughs 49. A pair of O-rings 48 act as sealing members as well as spacers between the heat sink 36 and the patch antenna 40. The four transistors denoted by A,–A, B and –B, are operated in anti-phase parallel pairs. The transistors A and –A oppose one another, are electrically spaced by about one-half wavelength ($\lambda/2$) apart, and are connected to a first microwave signal generator 50 by a stripline conductor 51. Transistors B and –B are also spaced a half wavelength apart, are oriented in orthogonal quadrants relative to transistors A and –A, and are connected to a second microwave generator 52 by a stripline conductor 53. Although two separate microwave generators are shown in the preferred embodiment, a single microwave generator could be utilized, if desired. The microwave generators 50 and 52 preferably comprise semiconductor microwave oscillators of any convenient design which can output microwave frequencies established for microwave heating. Typically, 2450 MHz is used world wide for microwave ovens and in North and South America 915 MHz is normally used for industrial heating applications where the larger size of the magnetron can be tolerated. In other parts of the world, still other designated frequencies can be used.

The pairs A, –A and B, –B of silicon bipolar power transistors are used to amplify the respective microwave signals applied thereto from the microwave generators 50 and 52 and each transistor of a pair is operated with a mutual phase difference of substantially 180° relative to the other transistor of the pair so as to excite a longitudinal mode. Accordingly, two mutually independent transverse longitudinal modes are excited at the same (2450 MHz) or different frequencies (915 MHz and 2450 MHz).

Each of the assigned frequencies also have a designated bandwidth. For example, in the case of the 915 MHz designation, the band is 26 MHz wide, while for 2450 MHz, the band is 100 MHz in width. In this invention, the operating frequency utilized is modulated within the allotted frequency band so as to prevent standing waves which cause uneven cooking from being produced within the heating chamber 14. This can be achieved in any desired manner. In FIG. 2, FM modulators 54 and 56 are shown simply coupled to the microwave oscillators 50 and 52 although it should be noted that modulators 54 and 56 could just as easily be connected between the oscillators 50 and 52 and their respective stripline coupling elements 51 and 53 or be incorporated into the transistor dies 44.

Due to variations in the material properties and manufacturing tolerances, it is usually necessary to fine tune microwave modules consisting of groups of transistors operating in parallel. This increases the cost of the modules by a considerable amount; however, by using air as the dielectric of the patch antenna, the variability introduced by variations by batch to batch of the dielectric constant of the material can be eliminated.

Figure 3:
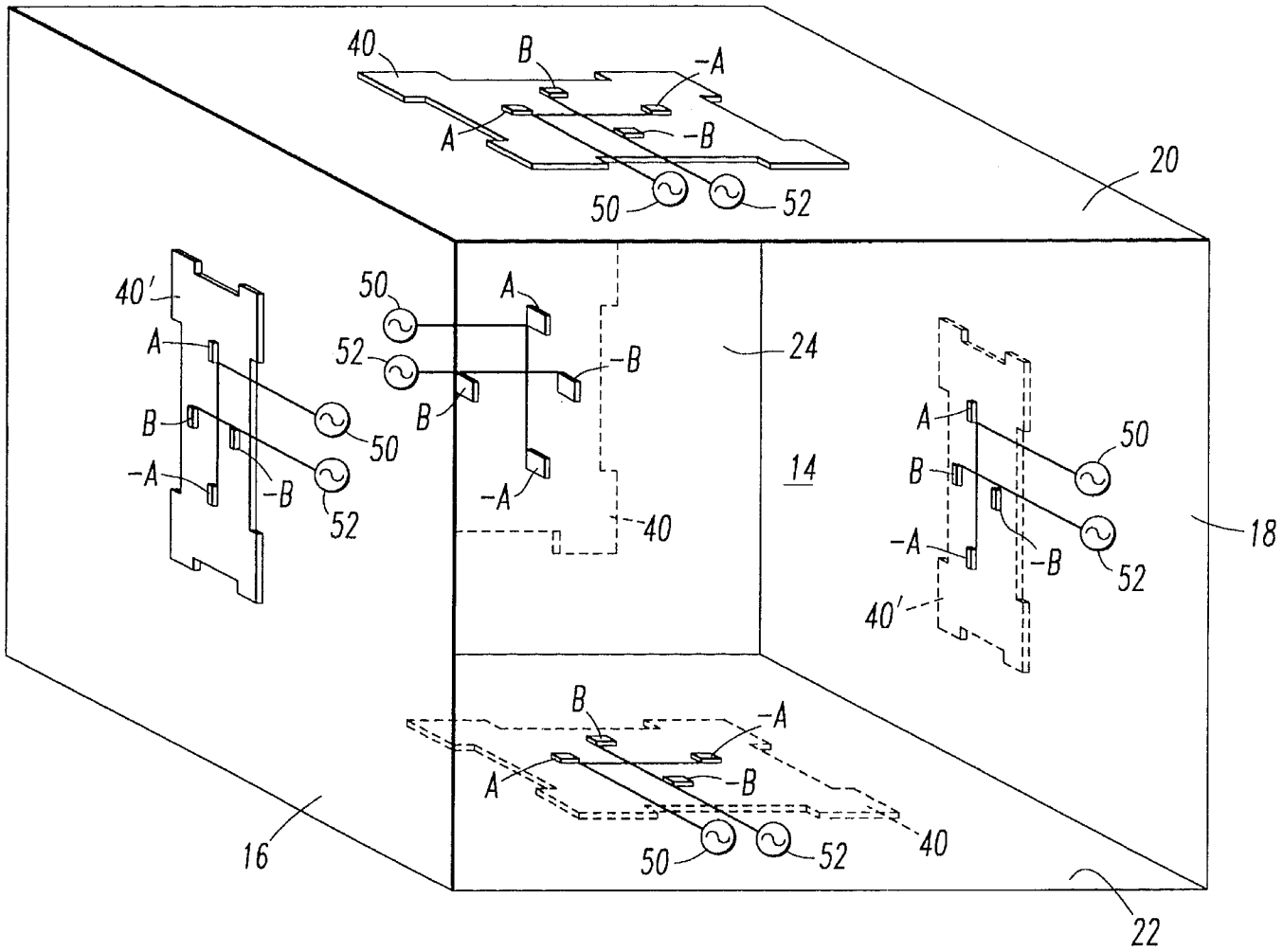
FIG. 3 is a perspective view generally illustrative of a microwave oven configuration including multiple radiating structures.

The manufacturing tolerances of the transistors and the patch are sufficiently accurate that the radiator can be automatically assembled without the need for any tuning. It should also be noted that the size of the patch type antenna element 40 is on the order of one half of the operating wavelength, which in the 915 MHz band is 16.4 cm and in the 2450 MHz band, is 6.1 cm. In the higher frequency band, the single antenna element 40 is quite small compared with the interior wall dimensions of a typical microwave oven and may be advantageous to operate several patch antennas on one or more walls such as shown in FIG. 3. In some applications, the patch antenna can be designed to operate, for example, at 915 MHz in one mode, and simultaneously at 2450 MHz in the orthogonal mode. In such an instance, the patch antenna 40' would be rectangular, being approximately 6.1 by 16.4 cm on a side. Such a configuration is shown in FIG. 3 where, for example, square shaped patch antennas 40 are located on the top, bottom and rear walls 20, 22 and 24, while rectangular shaped patch antennas 40' are located on the side walls 16 and 18.

A high powered microwave silicon bipolar transistor capable of operating in the microwave heating environment disclosed above, is depicted in cross section in FIG. 4. Referring now to FIG. 4, one of the microwave power transistors A (FIG. 2) comprises a grounded base transistor including a planar collector region 58 adjacent an N+ base region 60 which is contiguous to a P type emitter region 62. The emitter region 62 is coupled to the microwave signal generator 50 and the stripline conductor 51 (FIG. 1) by means of the layer of metallization 64 which is partially covered by an outside oxide layer 65. Beneath the oxide layer 65 is an intermediate oxide layer 66 through which a via 68 is formed where the metallization layer 64 connects to a ballast region of metallization 70 by way of the metallization 72. The ballast region 70 connects to the emitter region 62 by means of a layer of metallization 74 which is overlaid on a third level of oxide 76. The layer of oxide 76 overlays two additional oxide layers 78 and 80. The collector region 58 is further shown in contact with the heat sink 36 where it is then coupled to the antenna 40 by way of the layer of metallization 46 coming off to the side where it makes contact with the antenna connecting element 47.

Such a structure is capable of feeding power directly into a patch antenna 40 or 40' without the need for microwave transformers and can be directly connected to and incorporated into the transmitting antenna configuration as shown in FIGS. 1 and 2, thereby enabling the elimination of matching and transistor combining networks. This feature results in a relatively low cost microwave source that will enable solid state devices to be applied to microwave heating applications instead of conventional magnetrons.

While the foregoing detailed description of the preferred embodiment of the invention has been directed to a solid state microwave oven assembly, it should be noted that the subject invention is not limited to such a use, but has other applications as well. For example, it can be used in mining and metallurgy where desulfurizing of coal is required. It can be used in metal fabrication where in the processing of foundry cores, drying casting molds, drying pastes and washes and slip casting. It can also be utilized in the chemical industry where preheating and vulcanizing of rubber is required, processing polymers and devulcanizing rubber. It can also be used for other food and beverage applications such as tempering frozen food, drying pasta, noodles, cookies, onions, cooking heat products and even microwave freeze drying. Further, it can be used in the wooden and paper industry for the curing of wood composites and paper drying. It is even applicable to the apparel and textile industry where dye fixation is required as well as in the drying of yarns and leather.

Thus a myriad of other applications are available for this type of microwave power radiators.

Having thus shown and described what is at present considered to be the preferred embodiments of the invention, it should be noted that the same has been made by way of illustration and not limitation. Accordingly, all modifications, alterations and changes coming within the spirit and scope of the invention as set forth in the appended claims are herein meant to be included.

I claim:

1. A solid state microwave power source, comprising:

microwave signal generator means operated within a predetermined frequency range;

support means for solid state devices;

solid state microwave power amplification means coupled to said signal generator means, said amplification means being mounted on said support means and operated so as to excite a mode in a power radiating antenna;

said antenna having at least one low impedance connecting point, said power amplification means being integrated with said antenna and having a direct connection element connected to said at least one low impedance connecting point, whereby a radiating power mode is excited on the surface of said antenna.

2. A solid state microwave power source, for heating applications, comprising:

microwave signal generator means;

support means for solid state devices;

at least one pair of solid state microwave power amplification devices coupled in parallel to said signal generator means, being mounted on said support means and mutually separated by a fixed distance so as to operate in a predetermined microwave frequency range in an out of phase relationship for exciting a mode in a power radiating antenna; and a microwave power radiating antenna having a plurality of low impedance connecting points, said pair of power amplification devices being integrated with said antenna and having respective direct connection elements connected to two of said connecting points, whereby a first radiating power mode is excited on the surface of said antenna.

3. A solid state microwave power source according to claim 2 wherein said pair of amplification devices comprise a pair of transistors.

4. A solid state microwave power source according to claim 2 wherein said pair of amplification devices comprise a pair of microwave silicon bipolar power transistors.

5. A solid state microwave power source according to claim 4 wherein said out of phase relationship is about a 180 degree phase difference so as to excite a longitudinal mode.

6. A solid state microwave power source according to claim 5 wherein said transistors are mutually separated electrically by about one half wavelength of said predetermined microwave frequency.

7. A solid state microwave power source according to claim 4 wherein said radiating antenna comprises a patch type of antenna having a dimension on a side of about one half wavelength of said predetermined microwave frequency.

8. A solid state microwave power source according to claim 4 and wherein said support means comprises a heat sink.

9. A solid state microwave power source according to claim 2, and additionally comprising at least one other pair of said solid state microwave power amplification devices coupled in parallel to said signal generator means, also mounted on said support means and being mutually separated by a respective fixed distance between said one pair of power amplification devices so as to be in transverse alignment therewith, and said at least one other pair of power amplification devices operating in a predetermined microwave frequency range in a mutual out of phase relationship and exciting another mode in said antenna, said at least one other pair of power amplification devices also being integrated with said antenna and having respective direct connection elements connected to two other connecting points of said plurality of low impedance connecting points of said plurality of low impedance connecting points, whereby a second radiating power mode is excited on the surface of said antenna traverse to said first power mode.

10. A solid state microwave power source according to claim 9 wherein the respective electrical separation distance of said power amplification devices of both said pairs of power amplification devices is about one half wavelength of a frequency in the predetermined microwave frequency range at which said power amplification devices are operated.

11. A solid state microwave power source according to claim 10 wherein said pairs of power amplification devices are comprised of microwave power transistors.

12. A solid state microwave power source according to claim 11 wherein said power transistors are comprised of silicon bipolar power transistors.

13. A solid state microwave power source according to claim 10 wherein both said pairs of power amplification devices operate at the same frequency in a band of frequencies allowed for microwave heating.

14. A solid state microwave power source according to claim 13 and additionally including means for frequency modulating said same frequency of at least one of said pairs of power amplification devices for preventing the build-up of standing waves in a load.

15. A solid state microwave power source according to claim 13 and additionally including means for frequency modulating said same frequency of both said pairs of power amplification devices for preventing the build-up of standing waves in a load.

16. A solid state microwave power source according to claim 13 wherein said radiating antenna is generally square in configuration and having a length and width dimension of about one half wavelength of a frequency of said same frequency.

17. A solid state microwave power source according to claim 10 wherein both said pairs of power amplification devices operate at mutually different frequencies in bands of frequencies allowed for microwave heating.

18. A solid state microwave power source according to claim 17 wherein said microwave signal generator means comprises a pair of microwave signal generators operating in two different microwave frequency bands allowed for microwave heating.

19. A solid state microwave power source according to claim 18 and including means for frequency modulating at least one microwave frequency of said microwave frequency bands for preventing the build-up of standing waves in a load.

20. A solid state microwave power source according to claim 18 and including means for frequency modulating two microwave frequencies of said microwave frequency bands for preventing the build-up of standing waves in a load.

21. A solid state microwave power source according to claim 18 wherein said radiating antenna is generally rectangular and having a length dimension of about one half wavelength of one frequency of said two microwave frequency bands and a width dimension of about one half wavelength of another frequency of said two microwave frequency bands.

* * * * *